US007396321B1

(12) United States Patent
Flanagan

(10) Patent No.: US 7,396,321 B1
(45) Date of Patent: Jul. 8, 2008

(54) POUCH PACKAGING MACHINE HAVING ADJUSTABLE OPERATING ORIENTATIONS

(76) Inventor: Thomas Flanagan, 905 Harrison St. Suite 111, Allentown, PA (US) 18103

( * ) Notice: Subject to any disclaimer, the term of this patent is extended or adjusted under 35 U.S.C. 154(b) by 0 days.

(21) Appl. No.: 11/525,564

(22) Filed: Sep. 23, 2006

(51) Int. Cl.
*B31B 49/00* (2006.01)
*B31B 1/64* (2006.01)

(52) U.S. Cl. ..... 493/267; 493/193; 493/189; 493/209; 53/451; 53/559; 29/401.1

(58) Field of Classification Search ..... 493/187, 493/188, 189, 193, 195, 196, 209, 267; 53/452, 53/459, 451, 559; 29/401.1; 248/558, 645
See application file for complete search history.

(56) References Cited

U.S. PATENT DOCUMENTS 3,611,671 A * 10/1971 Skinner et al. ..... 53/495
3,741,405 A * 6/1973 McConnell et al. ..... 211/192
4,033,531 A * 7/1977 Levine ..... 248/558
4,066,234 A * 1/1978 Nycum ..... 248/558
4,068,448 A * 1/1978 Modeen ..... 53/131.3
4,215,524 A * 8/1980 Saylor ..... 53/554
4,493,178 A * 1/1985 Buckner et al. ..... 53/131.5
4,665,638 A * 5/1987 Morton ..... 38/102.1
4,768,330 A * 9/1988 Lane et al. ..... 53/554
4,996,819 A * 3/1991 Davis ..... 53/64
5,199,247 A * 4/1993 Bjorkman et al. ..... 53/554
5,235,794 A * 8/1993 Center ..... 53/437
5,637,071 A * 6/1997 Simmons et al. ..... 493/464
5,881,533 A * 3/1999 Focke et al. ..... 53/396
5,931,345 A * 8/1999 Lane et al. ..... 222/105
6,354,753 B1 * 3/2002 Jorgensen et al. ..... 400/120.01
6,854,242 B2 * 2/2005 Stork et al. ..... 53/53

* cited by examiner

*Primary Examiner*—Paul R Durand
(74) *Attorney, Agent, or Firm*—LaMorte & Associates

(57) ABSTRACT

A pouch packaging machine and method of selectively changing the orientation of a pouch packaging machine. The pouch packaging machine has at least one spool for holding at least one roll of packaging film material. The packaging film material advance through a press that joins the packaging film material together to form a pouch. The spools and press are supported on a common housing. The housing has a plurality of sides. Identical mounts are disposed on at least some of the sides of the housing. A base platform is provided. The mounts on the various sides of the housing are all configured to engage the base platform. This enables the housing of the pouch packaging machine to attach to the base platform in one of a multitude of possible orientations.

10 Claims, 3 Drawing Sheets

POUCH PACKAGING MACHINE HAVING ADJUSTABLE OPERATING ORIENTATIONS

BACKGROUND OF THE INVENTION

1. Field of the Invention

In general, the present invention relates to packaging machines that are used to package consumer products. More particularly, the present invention relates to packaging machines that make pouch packages by joining one or more films of material around a consumer product along a peripheral seam.

2. Prior Art Description

Many commercial products are created in an automated manufacturing line where the product passes through successive pieces of automated processing machinery. Typically, one of the last pieces of equipment in an automated manufacturing line is a packaging machine. The packaging machine receives a finished product and packages that finished product for sale to the public. The types of packaging machines that exist in the art are as diversified as the products being sold. However, the present invention is a pouch packaging machine that creates packaging by joining one or more sheets of material together around the product being packaged. Accordingly, only pouch packaging machines are herein addressed.

Pouch packaging machines have been in use for many decades. In this long period of time, pouch packaging machines have been made in a variety of configurations. A pouch packaging machine is loaded with one or more rolls of packaging material, such as plastic film or paper. The packaging material is joined together along a common peripheral edge to create an enclosed pouch or bag. A product is placed in between section of the packaging material as the pouch is being formed. Accordingly, the product becomes packaged within the pouch as the pouch is formed. The products can be solid, granular, liquid, cream or even gaseous. The various pouches are then cut apart to create the individually packaged products that are ready for sale.

Since a finished product must be introduced into a pouch packaging machine in order to be packaged, the size and shape of the product dictates much of the packaging machine's design. For instance, some products are best packaged while in a horizontal position. In such cases, the packaging machine is designed to form the packaging pouch around the product as it runs horizontally into the packaging machine along a conveyor belt. Packaging machines for such situations are said to be configured with a "horizontal feed". Conversely, some products are best packaged in a vertical orientation, where the product is poured into a pouch. In such situations, the packaging machine is constructed to make packaging pouches in the vertical plane. A packaging machine so configured is said to have a "vertical feed".

Packaging machines are often custom designed to package a particular product. In this manner, the packaging machine can be part of the overall automated processing line for that product. However, to justify the significant cost of designing and building a custom pouch packaging machine, the product being manufactured must be manufactured in large quantities. If a product is only manufactured in small quantities or in small batches, it is not practical to design and build a customized packaging machine for that product. Rather, for products made in small quantities, generalized packaging machines are most often used.

Generalized packaging machines are widely available. Such generalized packaging machines are stand-alone machines that may have either a vertical feed or a horizontal feed. Small run products are typically loaded into the machine in batches and are packaged. Thus, the packaging machine is not integrated as part of the automated manufacturing process. Rather, finished goods have to be carried to the packaging machine, loaded into the packaging machine and transferred away from the packaging machine after the packaging process is complete. This adds significantly to the labor and cost associated with manufacture. Furthermore, stand-alone pouch packaging machines are manufactured either to have a horizontal feed configuration or a vertical feed configuration, wherein the configurations cannot be changed. Thus, a manufacturer would need to have two different pouch packaging machines if sometimes a vertical feed packaging machine were needed and other times a horizontal feed packaging machine were needed.

A need therefore exists for a generalized pouch packaging machine that can be selectively changed into different configurations, thereby enabling one packaging machine to fit the changing packaging needs of a manufacturer. This need is met by the present invention as described and claimed below.

SUMMARY OF THE INVENTION

The present invention is a pouch packaging machine and the method of selectively changing the orientation of a pouch packaging machine. The pouch packaging machine has at least one spool for holding at least one roll of packaging film material. The packaging film material advances through a press that joins the packaging film materials together to form a pouch.

The spool(s) and press are supported on a common housing. The housing has a plurality of sides. Identical mounts are disposed on at least some of the sides of the housing.

A base platform is provided. The mounts on the various sides of the housing are all configured to engage the base platform. This enables the housing of the pouch packaging machine to attach to the base platform in one of a multitude of possible orientations. Accordingly, the pouch packaging machine can be oriented into a vertical feed orientation or a horizontal feed orientation with either vertical or horizontal packaging film progressions.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Figure 1:
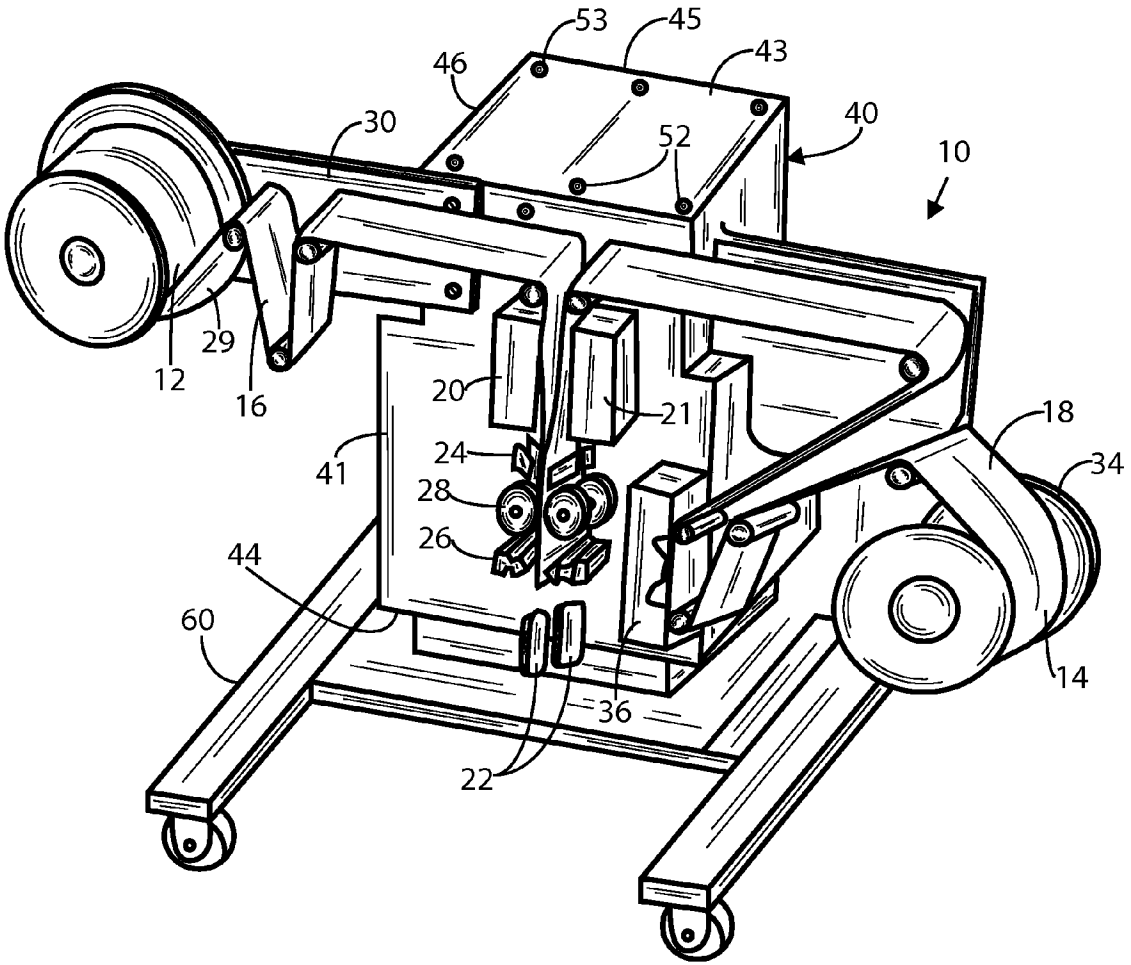
FIG. 1 is a front perspective view of an exemplary embodiment of a pouch packaging machine in a first orientation.
Figure 2:
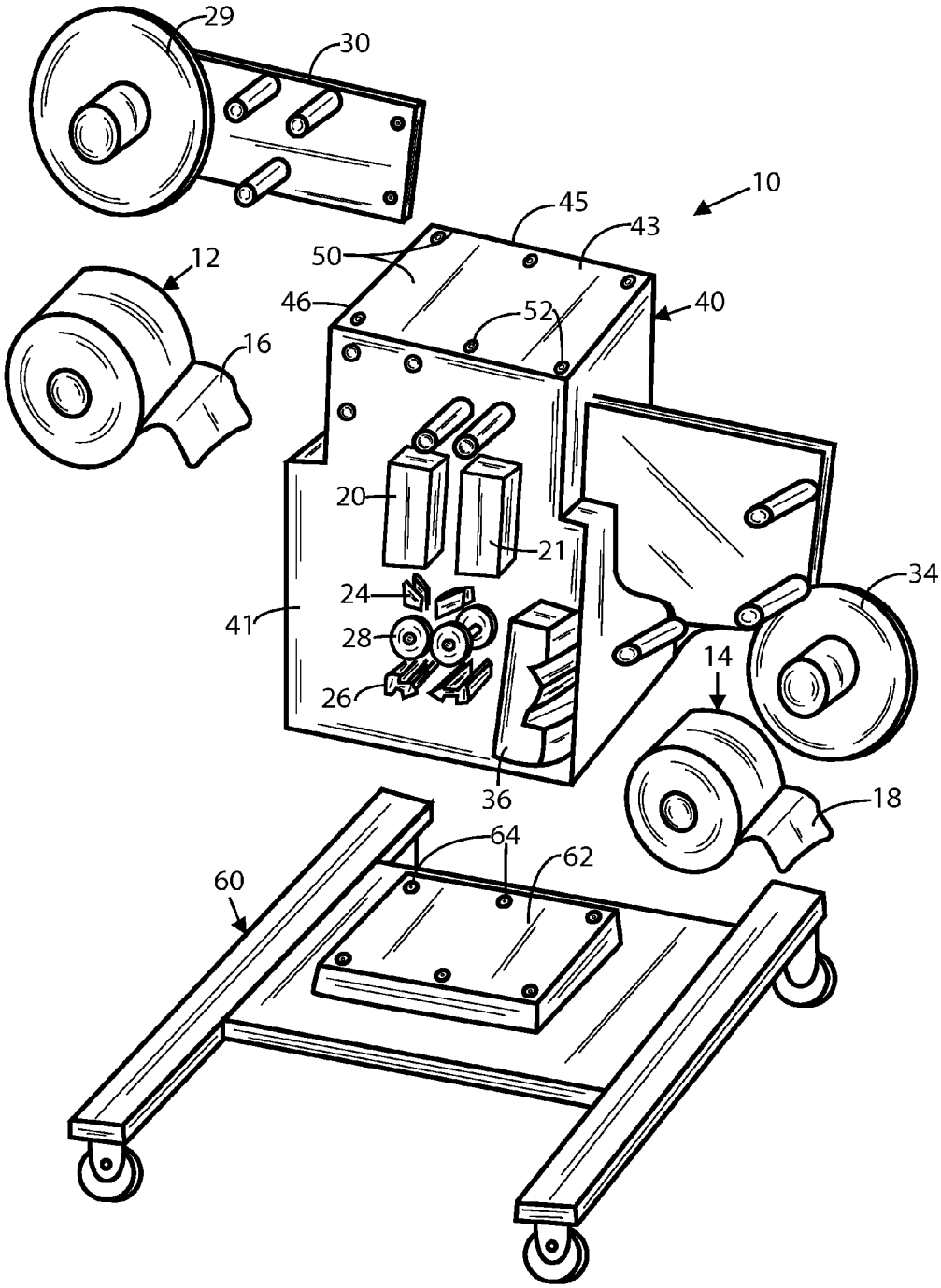
FIG. 2 is an exploded view of the embodiment of FIG. 1.

Referring to FIG. 1 in conjunction with FIG. 2, an exemplary embodiment of the present invention pouch packaging machine 10 is shown. The exemplary pouch packaging machine 10 is configured to hold two rolls 12, 14 of packaging film materials 16, 18. It will be understood that depending upon the type of packaging being made, the pouch packaging machine can be configured to hold only one roll of packaging film materials or more than two rolls of packaging film material. A configuration with two rolls 12, 14 of packaging film material 16, 18 is selected for ease of description.

The packaging film material used by the pouch packaging machine 10 can be either plastic film or paper-based material. The packaging materials 16, 18 are fed in a parallel orientation between two press heads 20, 21. The press heads 20, 21 press and heat the two packaging film materials 16, 18 together to make a pouch package 22 around a product. After the pouch package 22 exits from between the press heads 20, 21, the pouch package 22 is passed through a series of cutting mechanisms 24, 26 that cut the pouch package 22 to a proper size and length. A series of conveyor wheels 28 engage the packaging film materials 16, 18 and pull them off the rolls 12, 14 and through the pouch formation process.

In the shown embodiment, the two packaging film materials 16, 18 are arranged in parallel in a vertical plane between the press heads 20, 21. Accordingly, the pouch packaging machine 10 is configured to have a vertical feed. As will later be explained in greater detail, the vertical feed configuration of the pouch packaging machine 10 can be selectively changed to fit the needs of a particular manufacturer.

The packaging film materials 16, 18 are held on two separate rolls 12, 14. The packaging film materials 16, 18 from the two rolls 12, 14 do not come together until the packaging film materials 16, 18 are compressed between the press heads 20, 21. The first roll 12 of packaging film material 16 is held on a first spool 29 at the end of a support arm 30. The packaging film material 16 from the first roll 12 passes through a first set of tensioning rollers 32 prior to reaching the forming area between the press heads 20, 21.

The second roll 14 of packaging film material 18 is held on a second spool 34. The packaging film material 18 from the second roll 14 passes along a printer 36. The printer 36 is computer controlled and prints information, such as product name and lot number directly onto the packaging film material 18. Such printed information ends up on the finished pouch package 22 after the pouch package 22 is formed and cut.

It will be understood that if the pouch packaging machine 10 is configured to hold only one roll or packaging film material only one spool need be used. Likewise, if more than two rolls of packaging film material are to be used, addition spools can be added.

The mechanisms, pneumatics and electronics used to operate the pouch packaging machine 10 are primarily contained within a primary housing 40. The press heads 20, 21, cutting mechanisms 24, 26 and conveyor wheels 28 extend outwardly from the front surface 41 of the primary housing 40. The operational controls, cable connects and hose connections (all not shown) are present on the left side surface 42 of the primary housing 40. It will therefore be understood that the top surface 43, bottom surface 44, back surface 45 and right side surface 46 of the primary housing 40 are not utilized. The top surface 43, bottom surface 44, back surface 45 and right side surface 46 of the primary housing 40 are herein referred to collectively as the free surfaces 50 of the primary housing 40.

An identical configuration of mounting holes 52 is disposed on each of the free surfaces 50 of the primary housing 40. In the shown embodiment, the configuration of mounting holes 52 consist of two parallel rows of three holes each. This results in six mounting holes. When not in use, the configuration of mounting holes 52 can be closed with plugs 53 to prevent debris from entering the primary housing 40. It will be understood that the shown configuration of mounting holes 52 is merely exemplary and that many other configurations can be used.

A base platform 60 is provided. In the shown embodiment, the base platform 60 is a wheeled structure having a mounting surface 62. The mounting surface 62 can be fixed or may be adjustable in height. For ease of description and illustration, a fixed mounting surface is shown.

A second configuration of mounting holes 64 is disposed on the mounting surface 62 of the base platform 60. The second configuration of mounting holes 64 corresponds in size and position to the first configuration of mounting holes 52 on the free surfaces 50 of the primary housing 40. It will therefore be understood that any of the four free surfaces 50 of the primary housing 40 can be selectively joined to the base platform 60 using standard mechanical fasteners, such as nuts and bolts. Accordingly, there are four distinct orientations that the primary housing 40 can have relative to the base platform 60.

The support arm 30 that holds the first roll 12 of packaging film material 16 attaches to the front surface 41 of the primary housing 40. However, the support arm 30 can be attached to the front surface 41 of the primary housing 40 in more than one orientation. By selectively changing the position of the primary housing 40 relative to the base platform 60 and by selectively changing the position of the support arm 30 relative the primary housing 40, the pouch packaging machine 10 can be configured in many different ways. This versatility in configuration enables the pouch packaging machine 10 to have both vertical feed and horizontal feed capabilities, thereby enabling the pouch packaging machine 10 to more readily adapt to different manufacturing needs.

In FIG. 1, the pouch packaging machine 10 is configured to have a vertical feed configuration. In this vertical feed configuration, the two packaging film materials 16, 18 extend vertically between the press heads 20, 21.

Figure 3:
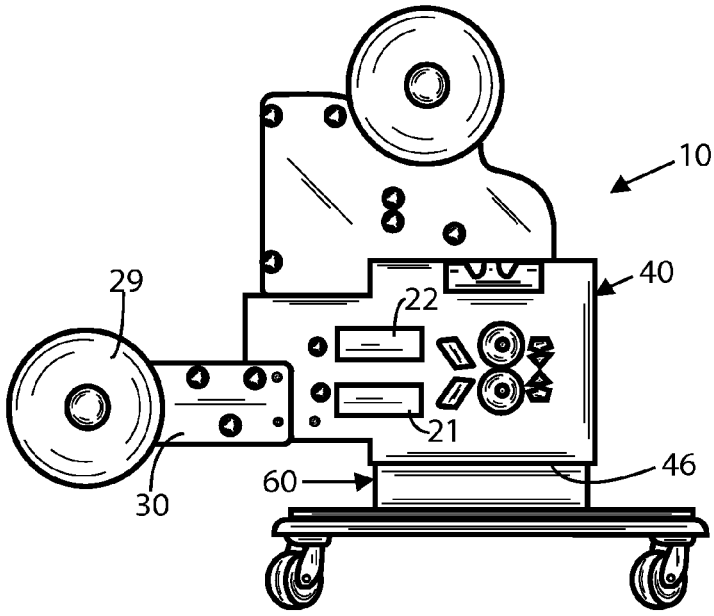
FIG. 3 is a front view of the pouch packaging machine in a second orientation.

Referring to FIG. 3, an alternate configuration of the pouch packaging machine 10 is shown. In this embodiment, the right side surface 46 of the primary housing 40 is bolted to the base platform 60 rather than the bottom surface 44 shown in FIG. 1. To prevent the first spool 29 from contacting the ground, the support arm 30 that holds the first spool 29 is moved ninety degrees so as to be parallel to the base platform 60. The support arm 30 is moved by unbolting the support arm 30 from the primary housing 40, reorienting the support arm 30 and bolting the support arm 30 in its new position.

When the right side surface 46 of the primary housing 40 is bolted to the base support 60, it can be seen that the two press heads 20, 21 align in the horizontal plane. The pouch packaging machine 10 therefore has a horizontal feed with a horizontal film progression.

Figure 4:
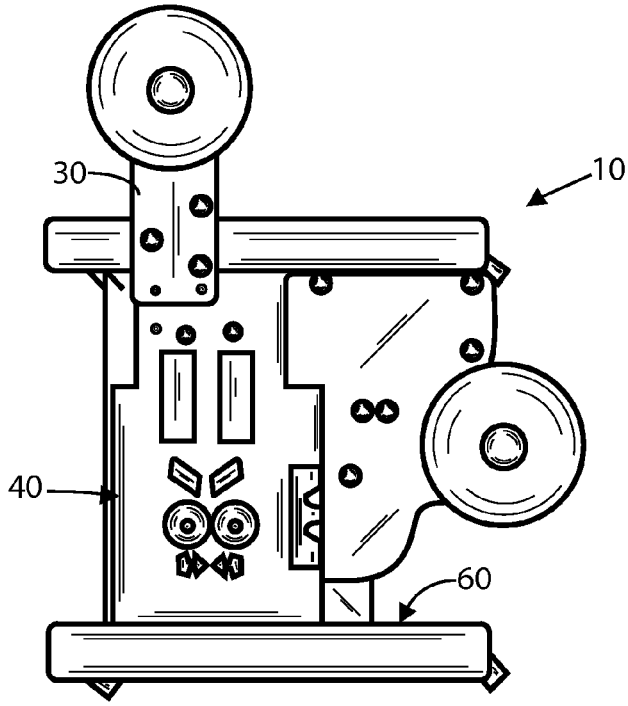
FIG. 4 is a top view of the pouch packaging machine in a third orientation.

Referring to FIG. 4, another configuration of the pouch packaging machine 10 is shown. In this embodiment, the back surface 45 (FIG. 1) of the primary housing 40 is bolted to the base platform 60 rather than the bottom surface 44 shown in FIG. 1 or the right side surface 46 shown in FIG. 3. It should be noted that FIG. 4 is a top view of the pouch packaging machine 10. FIG. 3 is a front view and FIG. 1 is a perspective front view. In FIG. 4, as such, the point of view is rotated from the front to the top and the previously presented vertical plane is now shown in and out of the plane of the paper.

The support arm 30 in the embodiment of FIG. 4 is not constrained by space. Although the support arm 30 is attached in the same manner as it is in the embodiment of FIG. 3, it can also be configured as in the embodiment of FIG. 1.

When the back surface 45 of the primary housing 40 is bolted to the base platform 60, it can be seen that the two press heads 20, 21 align in the horizontal plane. The pouch packaging machine 10 therefore has a horizontal film progression and can be fed either horizontally or vertically.

Referring to all figures, it will be understood that although the present invention is shown in the various figures with the bottom surface 44, right side surface 46 and back surface 45 attached to the base platform 60, it will be understood that the primary housing 40 can be fully inverted, wherein the top surface 43 attaches to the base platform 60. In such a configuration, the pouch packaging machine 10 would again have a vertical feed a with vertical film progression.

In the shown embodiments, two rolls of packaging film material are used. Consequently all embodiments of the present invention show two spools. It should be understood that the pouch packaging machine can be configured to operate with one roll of packaging film material or more than two rolls of packaging film material. Consequently, the position of the spools can be varied into positions not illustrated. What is important is that the support arms that hold the spools attach to the primary housing and that the primary housing be attachable to a base in a number of different orientations.

It will be understood that the embodiments of the present invention are merely exemplary and that a person skilled in the art can make many variations to the shown embodiments without departing from the intended scope of the invention. For instance, the base platform 60 can have any shape. Similarly, the primary housing 40 can also have any shape provided it has identical mounts on its various sides. Furthermore, the type and size of the packaging film materials 16, 18 used by the pouch packaging machine is a matter of choice. All such variations, modifications and alternate embodiments are intended to be included within the scope of the present invention as defined by the claims.

What is claimed is:

1. A method of orienting a pouch packaging machine, comprising the steps of:

providing a pouch packaging machine having a housing with multiple exterior surfaces that include a bottom surface, a rear surface and at least one side surface;

providing a common mounting configuration on said bottom surface, said rear surface and said at least one side surface;

providing a base platform having a top surface configured to engage said common mounting configuration;

selectively attaching one of said exterior surfaces with said common mounting configuration to said base platform, therein affixing said pouch packaging machine to said base platform in one of a plurality of possible orientations.

2. The method according to claim 1, wherein said pouch packaging machine includes at least one spool for holding packaging film material.

3. The method according to claim 2, further including the step of selectively moving said at least one spool into a different position depending upon which of said exterior surfaces of said housing is mounted to said base platform.

4. The method according to claim 1, wherein said common mounting configuration is a configuration of mounting holes.

5. The method according to claim 1, wherein said pouch packaging machine has a vertical feed configuration in at least one of said possible orientations and a horizontal feed configuration in at least one of said possible orientations.

6. A method of altering a pouch packaging machine between a vertical feed configuration and a horizontal feed configuration, comprising the steps of:

providing a pouch packaging machine having a front surface, a back surface, a top surface, a bottom surface and two side surfaces, wherein said bottom surface and at least one of said side surfaces has a common mount hole configuration formed therein;

providing a press that joins packaging film material into pouches, wherein said press is affixed to said front surface of said pouch packaging machine;

providing a base platform having a mounting hole configuration that matches said common mount hole configuration;

selectively mounting said bottom surface to said base platform, wherein said pouch packaging machine sits on said base platform in a vertical feed orientation; and detaching said base platform;

reorienting said pouch packaging machine on said base platform;

reattaching said pouch packaging machine to said base platform, therein causing said pouch packaging machine to have a horizontal feed orientation.

7. The method according to claim 6, wherein said step of reattaching said pouch packaging machine to said base platform includes attaching one of said side surfaces of said pouch packaging machine to said base platform.

8. The method according to claim 7, wherein said step of reattaching said pouch packaging machine to said base platform includes attaching said back surface of said pouch packaging machine to said base platform.

9. A packaging machine assembly, comprising:

a housing having a front surface, a rear surface, a top surface, a bottom surface and a plurality of side surfaces, wherein a common configuration of mounting holes are disposed on said bottom surface, said rear surface and at least one of said side surfaces;

at least one spool for holding at least one roll of packaging film material;

a support arm for attaching said at least one spool to said housing;

at least one press head for pressing a first segment of said packaging film material against a second segment of said packaging film material, therein producing a pouch package, wherein said at least one press head is affixed to said front surface of said housing; and a base platform having a top surface in which are disposed mounting holes that positionally match said common configuration of mounting holes, wherein any of said common configuration of mounting holes can selectively attach to said base platform, therein attaching said housing to said base platform in one of multiple possible orientations.

10. The assembly according to claim 9, wherein said support arm is selectively adjustable in position relative said housing.

* * * * *